US007472630B1

(12) United States Patent
Velluzzi

(10) Patent No.: US 7,472,630 B1
(45) Date of Patent: Jan. 6, 2009

(54) HAND TOOL WITH EXTENSIBLE HANDLE

(76) Inventor: Richard Velluzzi, 122 Clinton B. Fisk Ave., Staten Island, NY (US) 10314

( * ) Notice: Subject to any disclaimer, the term of this patent is extended or adjusted under 35 U.S.C. 154(b) by 0 days.

(21) Appl. No.: 11/751,319

(22) Filed: May 21, 2007

(51) Int. Cl.
*B25B 23/16* (2006.01)
*B25G 1/04* (2006.01)

(52) U.S. Cl. ..... 81/177.2; 81/177.6

(58) Field of Classification Search ..... 81/177.2, 81/489, 177.6, 180.1, 184, 185.2, 177.7, 81/177.8
See application file for complete search history.

(56) References Cited

U.S. PATENT DOCUMENTS

| | | | | | |
|---|---|---|---|---|---|
| 483,461 | A | | 9/1892 | Litel | |
| 1,003,997 | A | * | 9/1911 | Dudly, Sr. | 81/177.6 |
| 1,186,807 | A | * | 6/1916 | Litomy | 81/177.6 |
| 1,396,850 | A | * | 11/1921 | Klingbeil | 81/177.2 |
| 1,747,527 | A | * | 2/1930 | Peterson | 81/177.8 |
| 3,839,929 | A | | 10/1974 | Richards | |
| 4,607,406 | A | | 8/1986 | Davis, Jr. | |
| 4,729,281 | A | | 3/1988 | Holloway, Jr. | |
| 4,733,583 | A | | 3/1988 | Lewis | |
| 5,201,257 | A | | 4/1993 | Engel | |
| 5,396,820 | A | | 3/1995 | Baker | |
| 5,535,649 | A | * | 7/1996 | Waggle, Jr. | 81/177.2 |
| 5,996,448 | A | | 12/1999 | Suckage | |
| 6,257,102 | B1 | | 7/2001 | Perry | |
| 6,805,029 | B1 | | 10/2004 | Foster et al. | |
| 2006/0156870 | A1 | * | 7/2006 | Vachon | 81/177.2 |

* cited by examiner

*Primary Examiner*—Hadi Shakeri
(74) *Attorney, Agent, or Firm*—Seth Natter; Natter & Natter

(57) ABSTRACT

A hand tool is provided with a handle extension formed of a channel having a pair of side panels and a transverse spine panel. An articulated joint couples the channel to a handle of the tool. The articulated joint is formed by a pin which extends through registered "L" shaped slots in the side panels and a number one shaped slot formed through the handle adjacent its end. The handle extension can be rotated from a closed position, wherein the channel and the tool handle are juxtaposed, approximately 180° to an extension position for the application of increased torque or to an acute angle with respect to the handle. The channel may be locked in a selected position by a pivot latch, which is urged against a selected surface formed at the end of the handle.

14 Claims, 4 Drawing Sheets

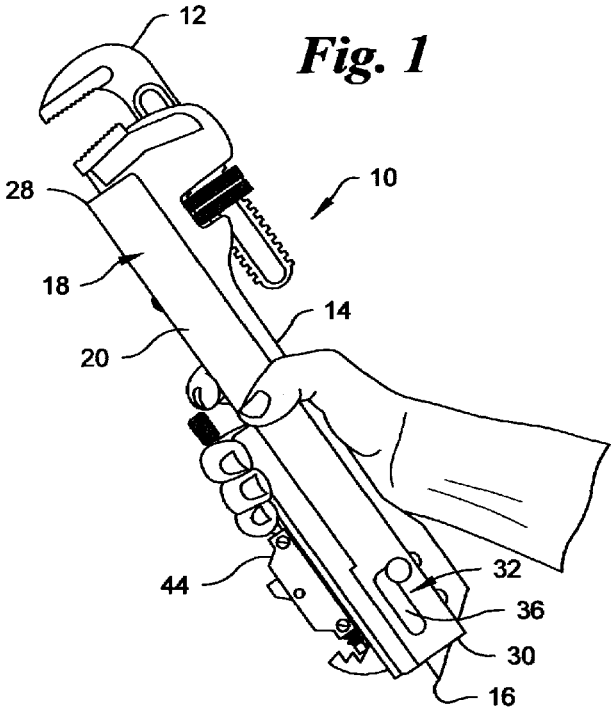
Fig. 1
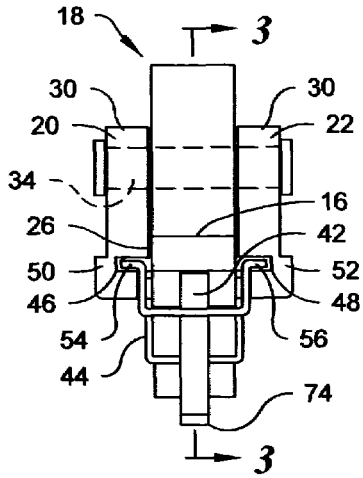
Fig. 2
Fig. 3
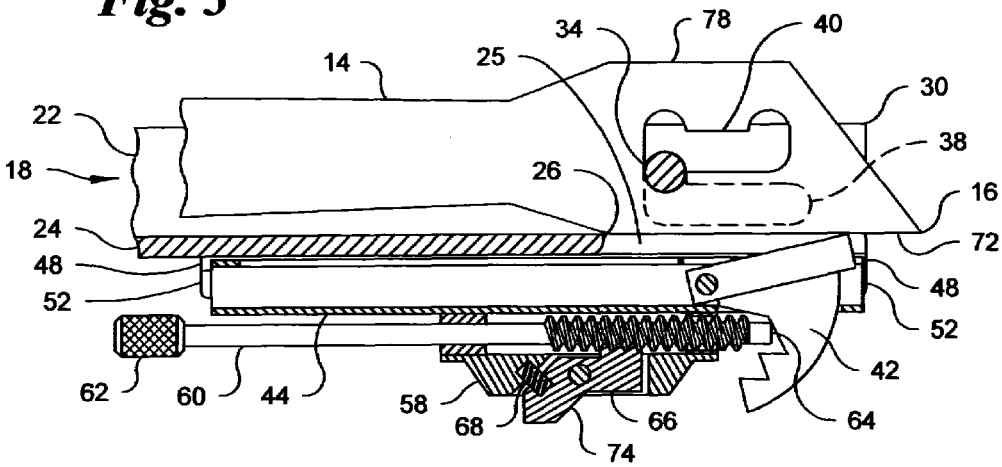

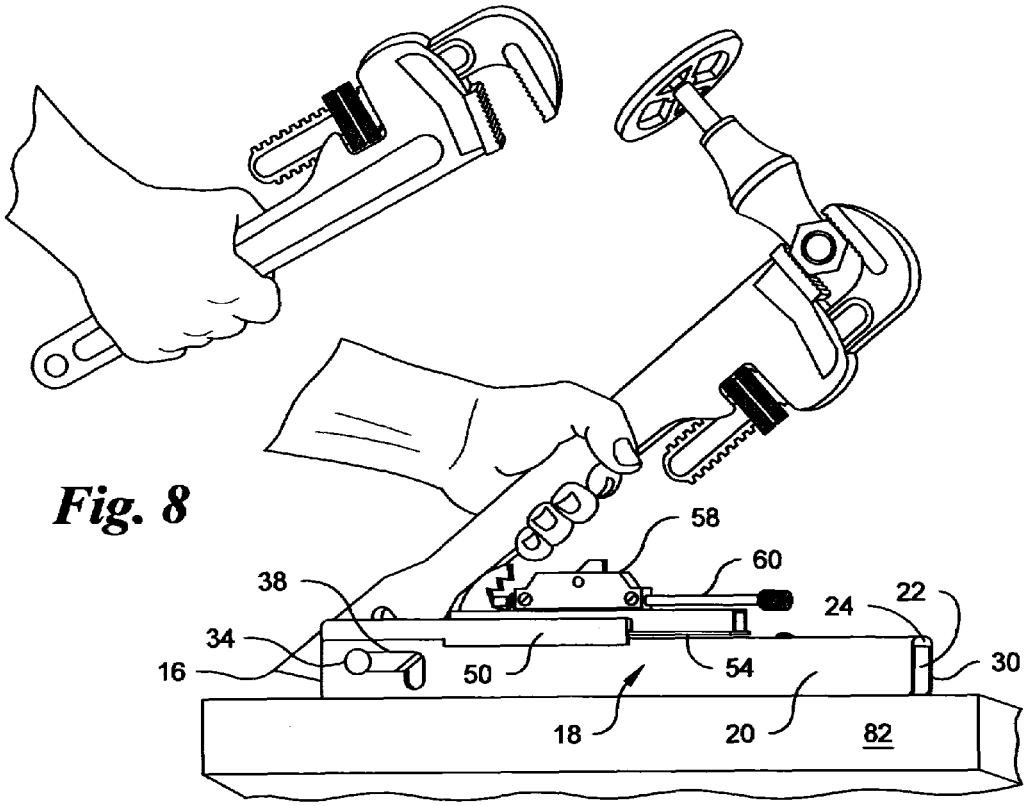
*Fig. 8*
*Fig. 9*
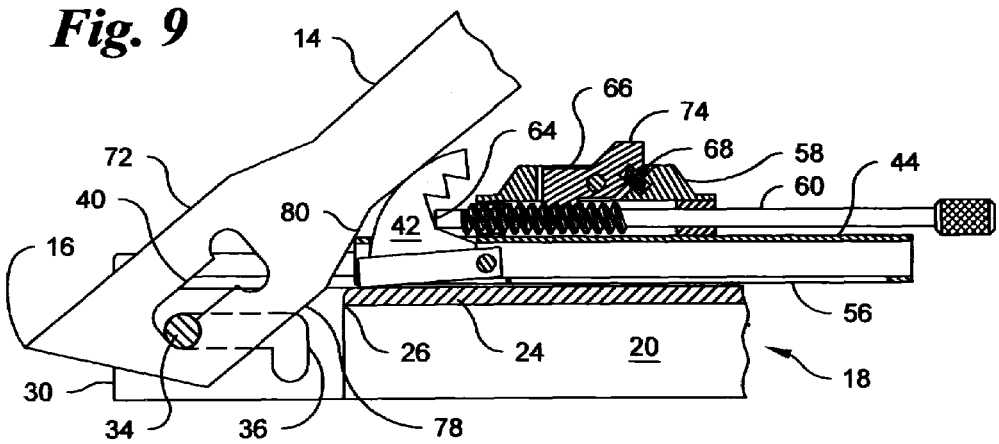

HAND TOOL WITH EXTENSIBLE HANDLE

BACKGROUND OF THE INVENTION

1. Field of the Invention

This invention relates generally to hand tools and more particularly to hand tools having extensible handles for providing increased torque and/or application versatility.

2. Antecedents of the Invention

Wrenches have been in use for many years. Different size wrenches were employed to grasp and turn fasteners, plugs, valves, etc., of different sizes. When the application of increased torque was required, one generally employed a larger wrench having increased handle length.

When larger wrenches were not available, mechanics have been known to increase the effective length of a wrench handle by sliding a length of pipe over the handle and applying torque to the wrench head through the pipe.

Unfortunately, lengths of pipe were not always available on site and further, pipe lengths were generally fabricated of material softer than the wrench itself. As a result, pipe extensions have been known to bend and deform.

There was a need therefore, for a hand tool with a sturdy extensible handle for the application of increased torque.

SUMMARY OF THE INVENTION

A hand tool with an extensible handle includes an elongate rigid handle having, at a distal end thereof, a tool head such as a wrench, spanner or socket. A handle extension is pivotally connected to the handle adjacent its proximal end at an articulated joint. The handle extension comprises a channel formed of a pair of substantially parallel side panels joined by a transverse spine panel.

In a closed position, the handle is nested between the side panels of the channel, however, the handle extension can be rotated at the articulated joint from the closed position to an extended position, so that increased torque can be applied at the tool head. The handle extension can be rotated beyond the extended position to form an acute angle between the handle extension and the handle. The free longitudinal edges of the side panels can then rest on a horizontal bench surface, supporting the handle and tool head at an acute angular orientation, to employ the hand tool as a freestanding bench tool.

The articulated joint includes a pin which extends through registered letter "L" shaped slots in the side panels and a number "1" shaped slot formed through the handle adjacent its proximal end.

A latch is pivotally mounted to a carriage which is slidable over the spine, while a screw mechanism is employed to force the latch against one of a plurality of contact faces formed at the proximal end of the handle to lock the extension in the closed, extended or acute angle position.

From the foregoing compendium, it will be appreciated that it is an aspect of the present invention to provide a hand tool with an extensible handle, which is not subject to the disadvantages of the antecedents of the invention aforementioned.

A consideration of the present invention is to provide a hand tool with an extensible handle of the general character described which is simple to use.

A feature of the present invention is to provide a hand tool with an extensible handle of the general character described which is well suited for economical mass production fabrication.

Another aspect of the present invention is to provide a hand tool with an extensible handle of the general character described which is sturdy and capable of exerting requisite torque for the task at hand.

Another feature of the present invention is to provide a hand tool with an extensible handle of the general character described which is relatively compact and can be easily carried and stored in a conventional tool box.

A still further consideration of the present invention is to provide a hand tool with an extensible handle of the general character described with a handle extension which may be fixed relative to a tool head in any of a number of different orientations.

To provide a hand tool with an extensible handle of the general character described which may be employed as a freestanding bench tool is a still further feature of the present invention.

Yet a further consideration of the present invention is to provide a hand tool with an extensible handle of the general character described which may be readily substituted for a number of differently sized individual tools.

Other aspects, features and considerations of the present invention in part will be obvious and in part will be pointed out hereinafter.

With these ends in view, the invention finds embodiment in the various combinations of elements, arrangements of parts and series of steps by which the aforesaid aspects, features and considerations and certain other aspects, features and considerations are attained, or with reference to the accompanying drawings and the scope of which will be more particularly pointed out and indicated in the appended claims.

BRIEF DESCRIPTION OF THE DRAWINGS

In the accompany drawings in which are shown one of the various possible exemplary embodiments of the invention.

FIG. 1 is a schematized perspective illustration of a hand tool constructed in accordance with and embodying the invention grasped for usage with a handle extension in its closed position wherein the handle extension and a tool handle are juxtaposed, FIG. 2 is an end elevational view showing a proximal end of the tool handle, FIG. 3 is an enlarged scale fragmentary longitudinal sectional view through the proximal end portion of the handle extension, the same being taken substantially along the line 3-3 of FIG. 2 and showing an articulated joint with cooperating slots formed in side panels of the handle extension and the proximal end of the handle, together with a latch which is urged against a contact face of the handle, FIG. 8 is a perspective illustration of the hand tool with the handle extension in an acute angle position and the hand tool being employed as a freestanding bench tool, and FIG. 9 is a longitudinal sectional view through the proximal end portion of the handle extension in the acute angle position and showing the engagement of the latch against a surface of the handle for maintaining the hand tool in such position.

DESCRIPTION OF THE PREFERRED EMBODIMENT

Figure 4:
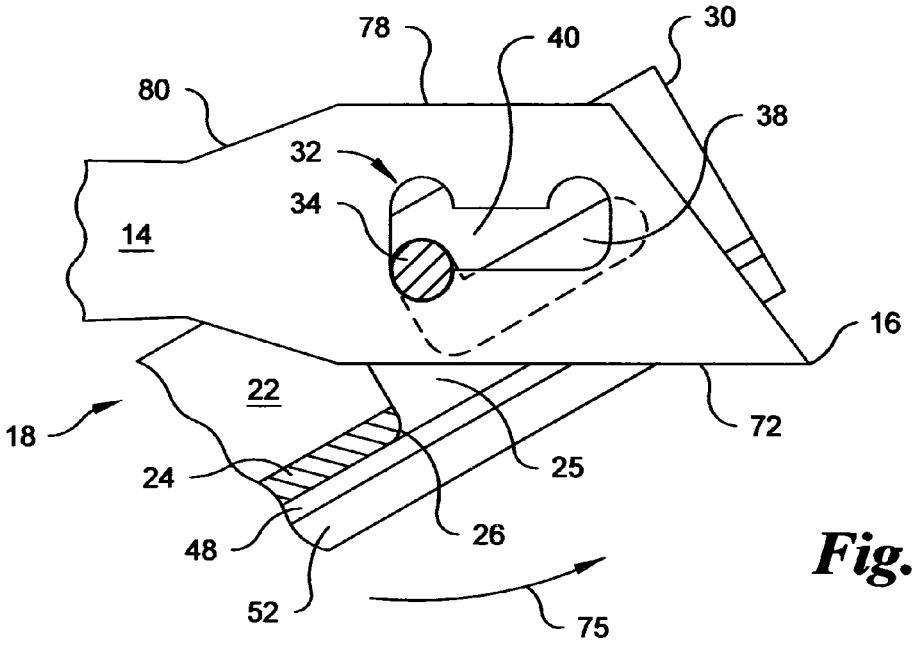
FIG. 4 is a fragmentary sectional view, similar to FIG. 3 with portions deleted for clarity, showing the relative positions of the handle and the handle extension at an initial stage of rotating the handle extension to an extended position.

Referring now in detail to the drawings, the reference numeral 10 denotes generally a hand tool having an extensible handle constructed in accordance with and embodying the invention. The hand tool 10 may comprise any type of tool which is employed to apply torque for the movement of one work piece relative to another or fixing one work piece relative to another work piece which is to undergo the application of the torque, such as a wrench including, by way of example only, an open end wrench, an adjustable jaw wrench, a monkey wrench, a box wrench, a socket wrench, a spanner, etc. The hand tool 10 thus includes a tool head 12 which is employed to grasp the surface of a work piece and a handle 14, having a distal end which is joined to the tool head 12.

In accordance with the invention, adjacent a proximal end 16 of the handle 14, a handle extension 18 is pivotally joined. The handle extension 18 comprises a generally U-shaped channel formed of a pair of generally parallel side panels 20, 22 and a transverse spine panel 24. As will be noted from an observation of FIG. 3, the spine panel does not span the full length of the side panels 20, 22, but extends from a free end 28 of the channel to an interior edge 26, leaving an open gap 25 between the side panels from the interior edge 26 to an articulated or joint end 30 of the channel.

Figure 6:
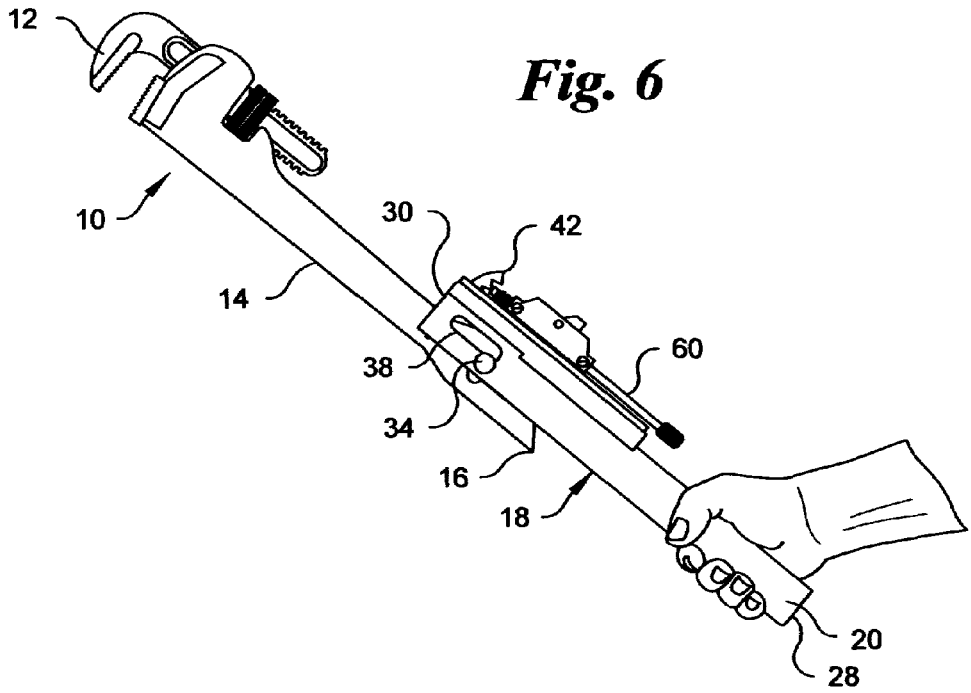
FIG. 6 is a schematized perspective illustration of the hand tool with the handle extension in its extended position for the application of increased torque.

Pursuant to the invention, the handle extension 18 can be rotated at an articulated joint, denoted generally by the reference numeral 32 from the juxtaposed closed position, illustrated in FIG. 1 to an extended position, illustrated in FIG. 6 and beyond to an acute angle position illustrated in FIG. 8. The articulated joint 32 includes a pivot pin 34 which extends through registered "L" shaped slots 36, 38 formed in the side panels 20, 22 respectively and through a number "1" shaped slot 40, formed through the handle adjacent a proximal end 16.

The handle extension 18 is maintained in its closed position, illustrated in FIG. 1, FIG. 2 and FIG. 3, by a latch 42, which is pivoted about a transverse pivot axis within a carriage 44. The carriage 44 is slidable along a pair of grooves 46, 48 formed in a pair of side panel extensions 50, 52 which project beyond the spine panel 24. As illustrated in FIG. 2, a pair of lateral flanges 54, 56 of the carriage 44 are engaged in the grooves 46, 48.

The carriage 44 includes a turret 58 which carries a threaded shaft 60 having a knob 62 at one end and a bearing surface 64 at the opposite end. A pivot link 66 is mounted to the turret 58 about a transverse axis. A spring 68, carried within the turret, bears against a portion of the pivot link 66. The pivot link 66 is urged by the spring 68 a counterclockwise direction, as viewed in FIG. 3, so that a threaded portion of the pivot link 66 engages a threaded portion of the threaded shaft 60.

Thus, when the shaft 62 is rotated, the bearing surface 64 exerts force against the latch 42 to pivot the latch 42 in a counterclockwise direction as viewed in FIG. 3 and urge the latch 42 through the gap 25 and against a generally planar surface 72 formed at the proximal end of the handle 14.

With the latch 42 being forced against the planar surface 72, the carriage 44 is held fast with its lateral flanges 54, 56 fixed in the grooves 46, 48 and with the handle extension 18 being fixed in its closed position, relative to the handle 14.

To move the handle extension 18 relative to the handle 14 from the juxtaposed closed position to the extended position illustrated in FIG. 6, the threaded shaft 60 may be rotated to disengage the bearing surface 64 from the latch 42. The shaft may also be axially moved away from the latch 42 by pivoting the threaded link 66 to disengage the threads of the pivot link 66 from the threads of the threaded shaft. Such disengagement may be effected by applying finger pressure to a surface 74 of the pivot link 66, against the bias of the spring 68. After the threaded shaft has been withdrawn, the carriage 68 may be slid along the slide panel extensions 50, 52 to the left, if oriented as illustrated in FIG. 3, until the latch is generally registered with the spine panel 24 and the gap 25 is free of obstructions.

Thereafter, the handle extension channel 18 is rotated about the pivot 34 in a clockwise direction, as indicated by the arrow 75, with the planar surface 72 and the proximal end 16 extending into the gap 25 between the side panels 20, 22 as shown in FIG. 4.

Figure 5:
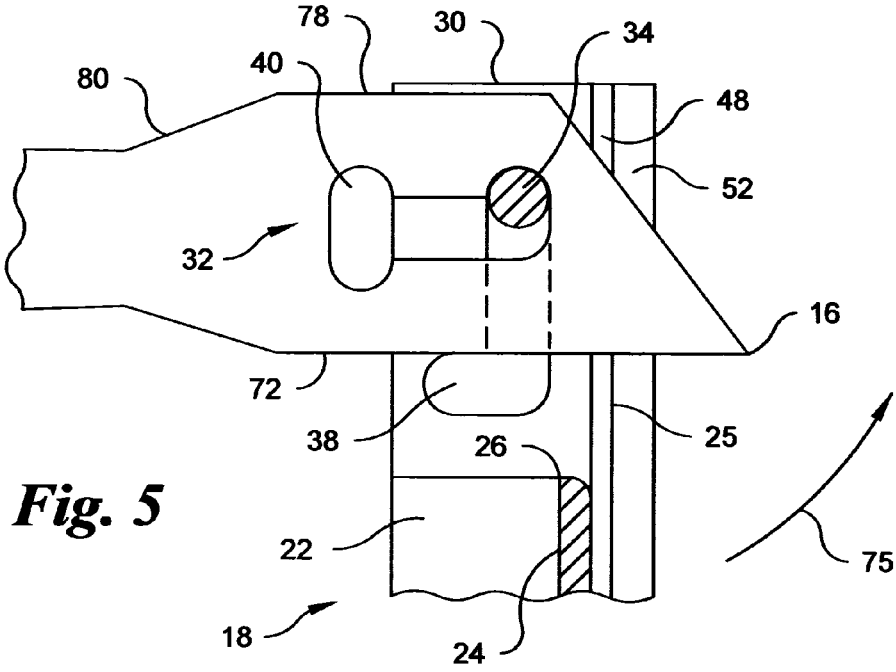
FIG. 5 is a fragmentary sectional view, similar to FIG. 4, but showing a further stage of rotation.

The handle 14 and the handle extension channel 18 are then moved away from one another in an axial direction, with the pin 34 moving from the base end of each "L" shaped slot 36, 38 to the head end. Simultaneously, the pin 34 moves from the base end of the "1" shaped slot to the head end as illustrated in FIG. 5. Rotation continues until the proximal end 16 of the handle 14 clears the interior edge 26 of the spine and the handle 14 and handle extension 18 lie in a straight angle.

Figure 7:
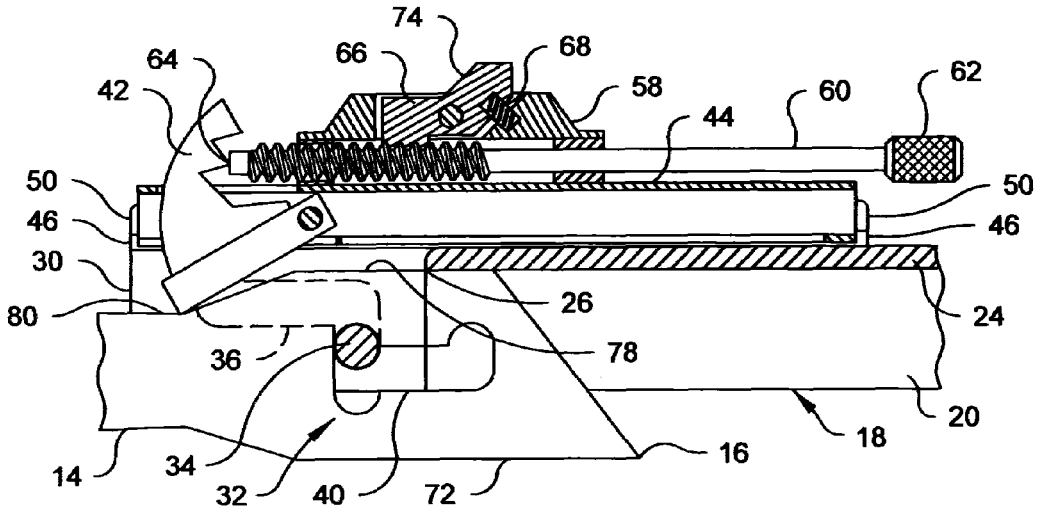
FIG. 7 is a fragmentary longitudinal sectional view through the proximal end portion of the handle extension, similar to FIG. 3, and showing the corresponding positions of a pivot pin, relative to the slots and further showing the latch engaging a surface of the handle for maintaining the handle extension in the extended position.

Thereafter, the handle extension 18 is moved upwardly and toward the tool head 18 until the handle 14 and the handle extension 12 are in the positions illustrated in FIG. 7, with a planar surface 78 of the handle abutting a portion of the spine 24 and with the carriage 44 being moved to the left. The carriage is then slid to partially cover the gap 25 and the shaft 60 is rotated to urge the latch 42 against a surface 80 of the handle, locking the handle extension 18 relative to the handle and fixing carriage 44 in its position.

With the handle extension 18 in the extended position as illustrated in FIG. 6, the effective length of the handle of the handle 14 is approximately doubled for the application of increased torque to the tool head 12.

The handle extension 18 may be moved from the extended position, to an acute angle position freestanding bench tool orientation illustrated in FIG. 8. To move the handle extension 18 relative to the handle 14 from the extended position of FIG. 6, the threaded shaft 60 is rotated or the pivot link 66 engaged to release the latch 42 and the carriage 44 is moved to the right, from the position indicated in FIG. 7, until the gap 25 is clear. Thereafter, the handle extension 18 is rotated counterclockwise relative to the handle 14 and the pivot pin 34 is disengaged from the base of the "1" shaped slot 40 and moved toward the head end of the slot 40. The handle 14 is then rotated clockwise into the gap 25 until it comes to rest bearing upon a surface of the latch 42.

The threaded shaft 60 is then rotated to urge the latch 42 against the spine panel 24, to fix the carriage 44, hence the latch 42, whereupon the hand tool 10 may be placed upon a flat bench or other work surface 82 and a hand tool may be employed as a freestanding bench tool, as illustrated in FIG. 8. The carriage 44 may be fixed relative to the handle 14 prior to resting the handle on the latch 42 and may be adjusted to a desired acute angle of orientation of the handle 14 relative to the handle extension 18.

It should be noted that the hand tool with extensible handle herein has been described in an exemplary manner only.

Thus it will be appreciated that there is provided a hand tool with extensible handle of the general character described which achieves the various aspects, features and considerations of the present invention and which is well suited to meet the conditions of practical usage.

As various possible further embodiments might be made of the present invention and as various changes might be made in the illustrative embodiment set forth herein without departing from the spirit of the invention, it is to be understood that all matter herein described or shown in the accompanying drawings is to be interpreted as illustrative and not in a limiting sense.

The invention claimed is:

1. A hand tool comprising a handle member having a distal end and a proximal end, a tool head at the distal end of the handle member, a handle extension member, the handle extension member being pivotally joined to the handle at an articulated joint adjacent the proximal end, the articulated joint comprising a pivot extending through the handle member and the handle extension member, at least one of the members including a slot, the pivot extending through the slot, the handle extension member comprising a channel having a pair of substantially parallel side panels and a spine panel, the pivot being capable of translational movement relative to the slot, whereby the handle extension member may be rotated at the articulated joint relative to the handle member from a closed position, wherein the handle member and the handle extension member are juxtaposed, to an extended position, wherein the handle member projects forwardly of the proximal end, the channel extending from a free end to an articulated end, the articulated end being adjacent the articulated joint and the spine panel extending from a free end of the channel to an interior edge, the interior edge being spaced from the articulated end leaving a gap between the side panels, the gap extending from the interior edge to the articulated end, whereby portions of the handle member will extend into the gap when the handle member and handle extension member are rotated relative to one another.

2. A hand tool as constructed in accordance with claim 1, the handle extension member including a slot through each side panel, the pivot extending through each slot.

3. A hand tool as constructed in accordance with claim 2 wherein the slot through each side panel is shaped substantially as the letter "L".

4. A hand tool as constructed in accordance with claim 3 further including a slot formed in the handle member, the slot being shaped substantially as the number "1", the pin extending through the handle member slot.

5. A hand tool as constructed in accordance with claim 1 wherein the slot is formed in the handle member.

6. A hand tool as constructed in accordance with claim 1 further including a latch releasably engaging a surface of the handle member for maintaining the handle member in the closed position and releasingly engaging a different surface of the handle member for maintaining the handle member in the extended position.

7. A hand tool comprising a handle member having a distal end and a proximal end, a tool head at the distal end of the handle member, a handle extension member, the handle extension member being pivotally joined to the handle at an articulated joint adjacent the proximal end, the articulated joint comprising a pivot extending through the handle member and the handle extension member, at least one of the members including a slot, the pivot extending through the slot, the pivot being capable of translational movement relative to the slot, whereby the handle extension member may be rotated at the articulated joint relative to the handle member from a closed position, wherein the handle member and the handle extension member are juxtaposed, to an extended position, wherein the handle member projects forwardly of the proximal end, a latch releasably engaging a surface of the handle member for maintaining the handle member in the closed position and releasingly engaging a different surface of the handle member for maintaining the handle member in the extended position and a carrier mounted for translational movement relative to the handle extension member, the latch being mounted to the carrier.

8. A hand tool as constructed in accordance with claim 7 wherein the latch is pivotally mounted to the carrier.

9. A hand tool as constructed in accordance with claim 7 wherein the handle extension member may be rotated relative to the handle member from the closed position or from the extended position to an acute position wherein the handle member and the handle extension member intersect at an acute angle, the latch engaging a further surface of the handle member for maintaining the handle extension in the acute position, whereby the hand tool may be employed as a free-standing bench tool.

10. A hand tool comprising a handle member having a distal end and a proximal end, a tool head at the distal end of the handle member, a handle extension member, the handle extension member being pivotally joined to the handle at an articulated joint adjacent the proximal end, the articulated joint comprising a pivot extending through the handle member and the handle extension member, at least one of the members including a slot, the pivot extending through the slot, the pivot being capable of translational movement relative to the slot, whereby the handle extension member may be rotated at the articulated joint relative to the handle member from a closed position, wherein the handle member and the handle extension member are juxtaposed, to an extended position, wherein the handle member projects forwardly of the proximal end, a latch releasably engaging a surface of the handle member for maintaining the handle member in the closed position and releasingly engaging a different surface of the handle member for maintaining the handle member in the extended position and a screw mechanism engageable with the latch, the screw mechanism selectively engaging the latch to apply an engagement force between the latch and the surface of the handle member.

11. A hand tool as a handle member having a distal end and a proximal end, a tool head at the distal end of the handle member, a handle extension member, the handle extension member being pivotally joined to the handle at a joint adjacent the proximal end, the joint comprising a pivot extending through the handle member and the handle extension member, the handle extension member being rotatable relative to handle member from a closed position, wherein the handle member and the handle extension member are juxtaposed, to an extended position, wherein the handle member projects forwardly of the proximal end, the handle extension member comprising a channel having a pair of substantially parallel side panels and a spine panel, the handle extension member including a slot through each side panel, the pivot extending through each slot, the channel extending from a free end to a pivot end, the pivot end being adjacent the pivot, the spine panel extending from a free end of the channel to an interior edge, the interior edge being spaced from a pivot end, leaving a gap between the side panels, the gap extending from the interior edge to the pivot end, the latch selectively extending into the gap to engage a surface of the handle member.

12. A hand tool comprising a handle member having a distal end and a proximal end, a tool head at the distal end of the handle member, a handle extension member, the handle extension member being pivotally joined to the handle member at a joint adjacent the proximal end, the joint comprising a pivot extending through the handle member and the handle extension member, the handle extension member comprising a channel having a pair of substantially parallel side panels and a spine panel, the pivot extending through each side panel, the handle extension member being rotatable relative to the handle member to a position wherein the handle member is at an acute angle relative to the handle extension member the hand tool further comprising a latch releasably engaging a surface of the handle member to maintain the handle member at the acute angle relative to the handle extension member the channel extending from a free end to a pivot end, the pivot end being adjacent the pivot, the spine panel extending from the free end of the channel to an interior edge, the interior edge being spaced from the pivot end of the channel leaving a gap between the side panels, the gap extending from the interior edge to the pivot end, the latch selectively extending into the gap to engage a surface of the handle member.

13. A hand tool as constructed in accordance with claim 12 further including a carrier slidably mounted to the handle extension member, the carrier including the latch.

14. A hand tool as constructed in accordance with claim 12 wherein the latch releasably engages a different surface of the handle member for maintaining the handle extension member in a different position.

* * * * *